US012044084B2

(12) United States Patent
Andersen

(10) Patent No.: US 12,044,084 B2
(45) Date of Patent: Jul. 23, 2024

(54) HYDRAULICALLY DRIVEN DOWNHOLE SELF-PROPELLING WIRELINE TOOL STRING

(71) Applicant: WELLTEC A/S, Allerød (DK)

(72) Inventor: Tomas Sune Andersen, Allerød (DK)

(73) Assignee: WELLTEC A/S, Allerød (DK)

( * ) Notice: Subject to any disclaimer, the term of this patent is extended or adjusted under 35 U.S.C. 154(b) by 0 days.

(21) Appl. No.: 17/962,891

(22) Filed: Oct. 10, 2022

(65) Prior Publication Data

US 2023/0110460 A1 Apr. 13, 2023

(30) Foreign Application Priority Data

Oct. 11, 2021 (EP) ..... 21202037
Nov. 29, 2021 (EP) ..... 21211104

(51) Int. Cl.
*E21B 23/14* (2006.01)
*E21B 23/00* (2006.01)

(52) U.S. Cl.
CPC ..... *E21B 23/001* (2020.05); *E21B 23/14* (2013.01)

(58) Field of Classification Search
CPC .... E21B 23/001; E21B 23/0419; E21B 23/14; E21B 43/128
See application file for complete search history.

(56) References Cited

U.S. PATENT DOCUMENTS

2005/0145415 A1* 7/2005 Doering ..... E21B 4/18 175/24
2013/0068479 A1* 3/2013 AlDossary ..... E21B 4/18 166/381

(Continued)

*Primary Examiner* — Christopher J Sebesta
(74) *Attorney, Agent, or Firm* — Nixon & Vanderhye P.C.

(57) ABSTRACT

The present invention relates to a downhole self-propelling wireline tool string for being connected to and powered by a wireline for propelling a tool forward in a well and/or for providing weight on a bit while performing an operation, comprising a first downhole self-propelling wireline tool, comprising a first tool body, a first electric motor operating at a rotational speed, a first electric control unit for controlling the rotational speed of the electric motor, one first drive section, comprising a plurality of projectable arm assemblies movably connected at a first arm end with the tool body and projectable from the tool body by means of a first fluid having a first fluid pressure, and a plurality of wheels for contacting a wall of the well, each wheel comprising a hydraulic motor for rotation of the wheel to provide a self-propelling movement, and each wheel being connected with a second arm end of one of the arm assemblies, a first hydraulic pump driven by the electric motor for generation of a second fluid pressure for driving the hydraulic motor(s) rotating the wheel(s), and wherein the downhole self-propelling wireline tool string further comprises a second downhole self-propelling wireline tool, comprising a second tool body, a second electric motor operating at a rotational speed, a second electric control unit for controlling the rotational speed of the electric motor, one second drive section comprising a plurality of projectable arm assemblies movably connected at a first arm end with the tool body and projectable from the tool body by means of a first fluid having a third fluid pressure, and a plurality of wheels for contacting the wall of the well, each wheel comprising a hydraulic motor for rotation of the wheel, and each wheel being connected with a second arm end of one of the arm assemblies, at least one second hydraulic pump driven by the second electric motor for generation of a fourth fluid pressure for driving the hydraulic motor(s) rotating the wheel(s), and wherein each electric motor comprises a power-limiting unit in order to distribute a first part of the current from the wireline to power the first electric motor and a second part of the current to power the second electric motor.

20 Claims, 7 Drawing Sheets

(56) References Cited

U.S. PATENT DOCUMENTS

Figure 1:
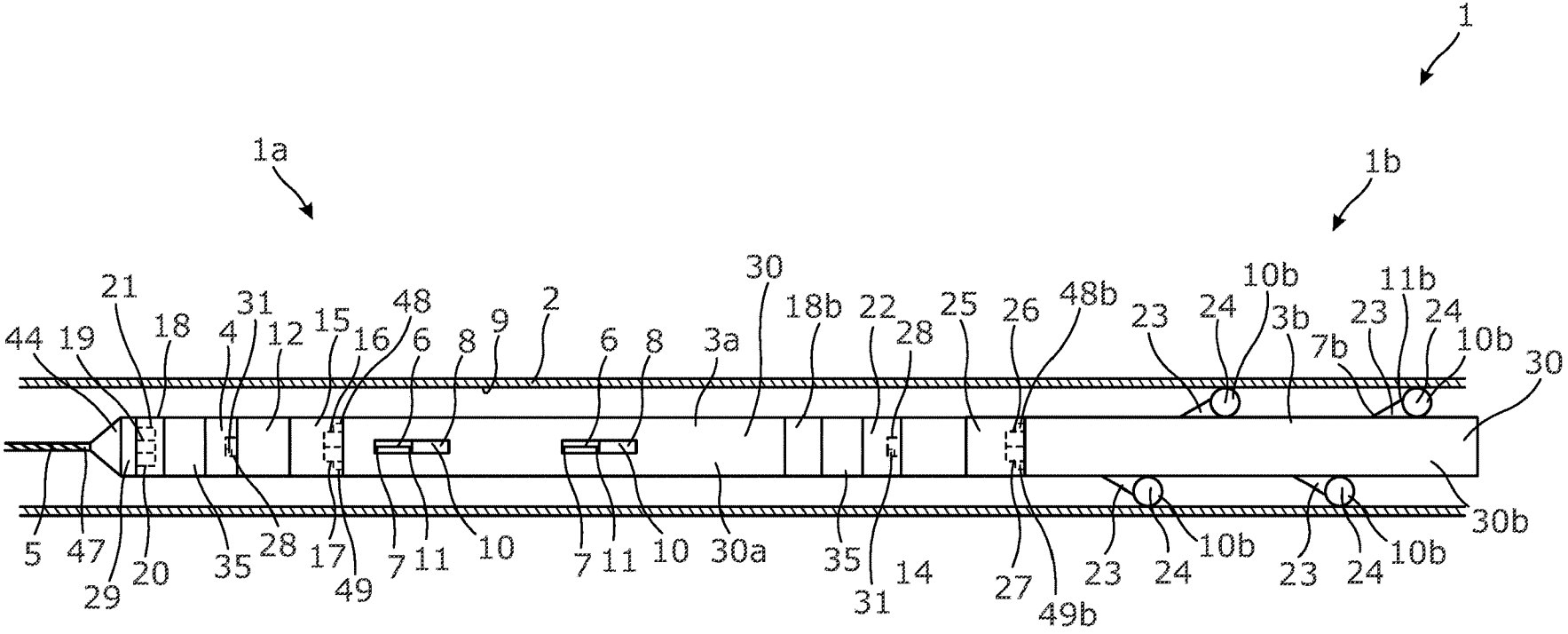

| | | | | |
|---|---|---|---|---|
| 2014/0014368 | A1* | 1/2014 | Hallundbæk | E21B 23/04 166/381 |
| 2014/0116729 | A1* | 5/2014 | Al-Mulhem | E21B 23/14 166/243 |
| 2020/0056462 | A1* | 2/2020 | Xiao | H02K 1/2791 |
| 2020/0200194 | A1* | 6/2020 | McInally | F15B 11/161 |
| 2023/0020636 | A1* | 1/2023 | Qi | E21B 23/14 |

* cited by examiner

HYDRAULICALLY DRIVEN DOWNHOLE SELF-PROPELLING WIRELINE TOOL STRING

This application priority to EP Patent Application No. 21202037.4 filed Oct. 11, 2021, and EP Patent Application No. 21211104.1 filed Nov. 29, 2021, the entire contents of each of which are hereby incorporated by reference.

DESCRIPTION

The present invention relates to a downhole self-propelling wireline tool string for being connected to and powered by a wireline for propelling a tool forward in a well and/or for providing weight on a bit while performing an operation comprising a first downhole self-propelling wireline tool.

Well intervention is carried out for various reasons to perform an operation, such as pulling a sleeve, milling a nipple, pulling or setting a plug, and is carried out by means of a self-propelling driving unit propelling the operational tool forward in the well. While propelling the tool forward in the well, the driving unit also needs to pull the wireline with it, and as the tool is driven further and further down the well, the power for pulling the wireline increases. Due to the fact that the wireline is rated to the maximum allowable current limit, the speed of the driving unit in the last part of the well is calculated based on the power available in the last part of the well for pulling the wireline, and the driving unit is adjusted at surface to drive at the calculated speed, even though more power is available in the first part of the well where less power is needed for pulling the wireline as the wireline is shorter. In order to be able to provide sufficient pulling force for pulling the wireline, the self-propelling driving unit is hydraulically driven and has wheels on wheel arms where each wheel is driven by a hydraulic motor in the wheel, and the wheel is pressed against the wall of the casing or the borehole also by means of hydraulics.

When the hydraulically driven self-propelling driving unit needs to propel down in a more inaccessible, deviated or horizontal part of the well to the position in which the operation is to be performed, more pulling force is needed in the last part of the well, and then more hydraulically driven drive sections are added, providing more wheels engaging the wall of the well to provide more pulling force. In the known hydraulically driven self-propelling driving units, the pulling force is approximately doubled when a further drive section is added, but the speed of the self-propelling driving unit is reduced by half.

In order to increase the speed in the top part of the well, some hydraulically driven self-propelling driving units have a first section of drive sections and a second section of drive sections, and when driving in the first part of the well the second section is turned off so that all power is distributed to the first section, and in this way the self-propelling driving unit is capable of driving at a higher speed than when both sections are activated. Such driving units can then drive at two different speeds and still provide the pulling force needed in the bottom part of the well.

It is an object of the present invention to wholly or partly overcome the above disadvantages and drawbacks of the prior art. More specifically, it is an object to provide an improved hydraulically driven downhole self-propelling wireline tool string being able to provide the maximum available pulling force due to current restriction in the wireline without reducing the ability to drive fast.

The above objects, together with numerous other objects, advantages and features, which will become evident from the below description, are accomplished by a solution in accordance with the present invention by a downhole self-propelling wireline tool string for being connected to and powered by a wireline for propelling a tool forward in a well and/or for providing weight on a bit while performing an operation comprising a first downhole self-propelling wireline tool, comprising:

- a first tool body,
- a first electric motor operating at a rotational speed,
- a first electric control unit for controlling the rotational speed of the electric motor,
- one first drive section, comprising
  - a plurality of projectable arm assemblies movably connected at a first arm end with the tool body and projectable from the tool body by means of a first fluid having a first fluid pressure, and
  - a plurality of wheels for contacting a wall of the well, each wheel comprising a hydraulic motor for rotation of the wheel to provide a self-propelling movement, and each wheel being connected with a second arm end of one of the arm assemblies,
- a first hydraulic pump driven by the electric motor for generation of a second fluid pressure for driving the hydraulic motor(s) rotating the wheel(s), and wherein the downhole self-propelling wireline tool string further comprises a second downhole self-propelling wireline tool, comprising:

- a second tool body,
- a second electric motor operating at a rotational speed,
- a second electric control unit for controlling the rotational speed of the electric motor,
- one second drive section, comprising:
  - a plurality of projectable arm assemblies movably connected at a first arm end with the tool body and projectable from the tool body by means of a third fluid having a third fluid pressure, and
  - a plurality of wheels for contacting the wall of the well, each wheel comprising a hydraulic motor for rotation of the wheel, and each wheel being connected with a second arm end of one of the arm assemblies,
- at least one second hydraulic pump driven by the second electric motor for generation of a fourth fluid pressure of a fourth fluid for driving the hydraulic motor(s) rotating the wheel(s), and wherein each electric motor comprises a power-limiting unit in order to distribute a first part of the current from the wireline to power the first electric motor and a second part of the current to power the second electric motor.

By having a power-limiting unit, the power can be distributed optimally as a first part of the current from the wireline to power the first electric motor and a second part of the current to power the second electric motor. This enables driving the downhole self-propelling wireline tool string with one pump for each drive section.

Figure 7:
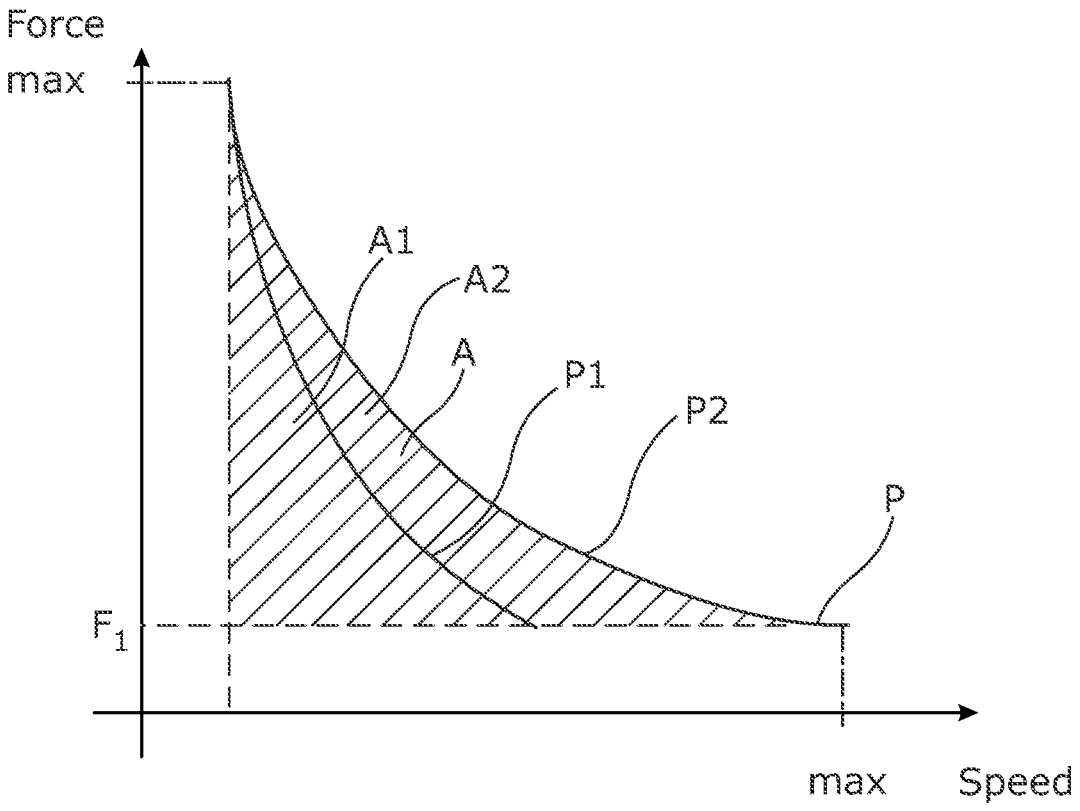

By having an electric motor and a pump for each drive section, the downhole self-propelling wireline tool string 1 is able to drive at full speed as one drive section and with double pulling force as two drive sections, as illustrated in FIG. 7 where P, $P_1$, and $P_2$ defines the same power consumption, e.g. 3 or 5 kW. $P_1$ is the power curve, e.g. 3 kW, of a known tool string having one pump for driving two drive sections, and $P_2$ is the downhole self-propelling wireline tool string of the present invention. At low speed, the available pulling force is the same for the known tool string and the tool string of the present invention, but the downhole self-propelling wireline tool string 1 having a pump for each drive section is at high speed able to drive twice as fast as the known tool string having only one pump for driving two drive sections. This is due to the fact that the pumped fluid does not have to travel past one drive section to be delivered to the next, and thus no energy is wasted in the transition from one drive section to the next drive section. By having one pump for one drive section, the diameter of the fluid channels in the drive section can be made larger than when the pump has to provide fluid to more than one drive section. The overall diameter of the tool string 1 is limited by the well, and the pump is therefore often a limiting factor as more pumping capacity would require a larger diameter. By having only one drive section, the pumping force is used directly, and the fluid channel can be made larger, for which reason the limited current in the wireline is used more efficiently than in the known tool strings where several drive sections are driven by one pump.

In addition, the power-limiting unit may be a current-limiting unit limiting the current supplied to the electric motor.

Also, the power-limiting unit may be a current limiter.

Furthermore, the power-limiting unit or the current-limiting unit may not be a relay or an on-off switch.

Additionally, the downhole self-propelling wireline tool string may comprise a current distribution unit in order to distribute a first part of the current from the wireline to power the first electric motor and a second part of the current to power the second electric motor.

Further, the downhole self-propelling wireline tool string may comprise a current distribution unit instead of the power-limiting units in order to distribute a first part of the current from the wireline to power the first electric motor and a second part of the current to power the second electric motor.

Moreover, the current distribution unit may distribute the current so that the first downhole self-propelling wireline tool and the second downhole self-propelling wireline tool equally consume the current from the wireline when the downhole self-propelling wireline tool string is activated.

Also, the first downhole self-propelling wireline tool and the second downhole self-propelling wireline tool may be configured to consume an equal part of the current from the wireline when the downhole self-propelling wireline tool string is activated.

Furthermore, the first drive section may be rotated 90 degrees from the second drive section so that the projectable arm assemblies of the first drive section are rotated 90 degrees from the projectable arm assemblies of the second drive section.

Additionally, the first electric control unit may be connected to the first electric motor, which is connected to the first hydraulic pump, which is connected with the first drive section.

Further, the first drive section may be connected to the second electric control unit or the second electric motor of the second downhole self-propelling wireline tool.

Moreover, the first downhole self-propelling wireline tool may further comprise a first pressure sensor continuously measuring the second fluid pressure, and the hydraulic section may comprise a first controllable valve controlling the first fluid pressure based on the second fluid pressure.

By having a first controllable valve controlling the first fluid pressure based on the second pressure, the wheels are not pressed more outwards than needed. The higher the second pressure, the higher the first pressure needs to be. When having a low second pressure, the first pressure is adjusted to match the low second pressure so that power is not wasted on providing a first fluid pressure higher than needed. Furthermore, if the first fluid pressure is higher than the optimal first fluid pressure matching the present second fluid pressure, then too much friction is applied to the wall of the well, compromising the maximum available velocity of the downhole driving unit.

In addition, the first hydraulic section may further comprise a second pressure sensor for measuring the first fluid pressure.

Also, the first hydraulic section may further comprise a second controllable valve controlling the second fluid pressure.

Furthermore, the second downhole self-propelling wireline tool may further comprise a third pressure sensor measuring the fourth fluid pressure and a second hydraulic section comprising a third controllable valve controlling the third fluid pressure based on the fourth fluid pressure.

Additionally, the second hydraulic section may further comprise a third pressure sensor for measuring the fourth fluid pressure.

Further, the second hydraulic section may also comprise a fourth pressure sensor for measuring the third fluid pressure.

Moreover, the second hydraulic section may comprise a fourth controllable valve controlling the fourth fluid pressure.

In addition, the first downhole self-propelling wireline tool may be connected in one end with the wireline and in another end with the second downhole self-propelling wireline tool.

Also, the first downhole self-propelling wireline tool may comprise two first drive sections, and the second downhole self-propelling wireline tool may comprise two second drive sections.

Furthermore, compared to a known self-propelling wireline tool with only one motor and one pump for four drive sections, the downhole self-propelling wireline tool string according to the present invention drives at least twice as fast and preferably almost four times as fast, but has the same pulling force as four drive sections.

Additionally, the first downhole self-propelling wireline tool may comprise a first hydraulic pump generating the first fluid pressure for projection of the plurality of projectable arm assemblies of the first drive section, and the second downhole self-propelling wireline tool may comprise a second hydraulic pump generating the third fluid pressure for projection of the plurality of projectable arm assemblies of the second drive section.

Further, the first hydraulic pump may generate the first fluid pressure for projection of the plurality of projectable arm assemblies of the first drive section, and the second hydraulic pump may generate the third fluid pressure for projection of the plurality of projectable arm assemblies of the second drive section.

Moreover, a fluid channel for the first fluid or the third fluid for projecting the arm assemblies from the tool body may have a first inner channel diameter, and the drive section may have an outer drive section diameter, where the ratio between the first inner channel diameter and the outer drive section diameter is higher than 0.3/10, preferably higher than 0.4/10, and more preferably higher than 0.5/10.

In addition, a second channel for the second fluid or the fourth fluid for driving the hydraulic motor(s) rotating the wheel(s) may have a second inner channel diameter, and the drive section may have an outer drive section diameter, where the ratio between the second inner channel diameter and the outer drive section diameter is higher than 0.5/10, preferably higher than 0.8/10, and more preferably higher than 1.0/10.

Also, the controllable valve(s) may be electronically controllable by means of the electric control unit.

Furthermore, three or more separately working downhole self-propelling wireline tools may be mounted as one downhole self-propelling wireline tool string. Thereby, a more modular downhole self-propelling wireline tool string is provided.

Finally, the current distribution unit may be arranged in the first electric control unit.

Figure 2:
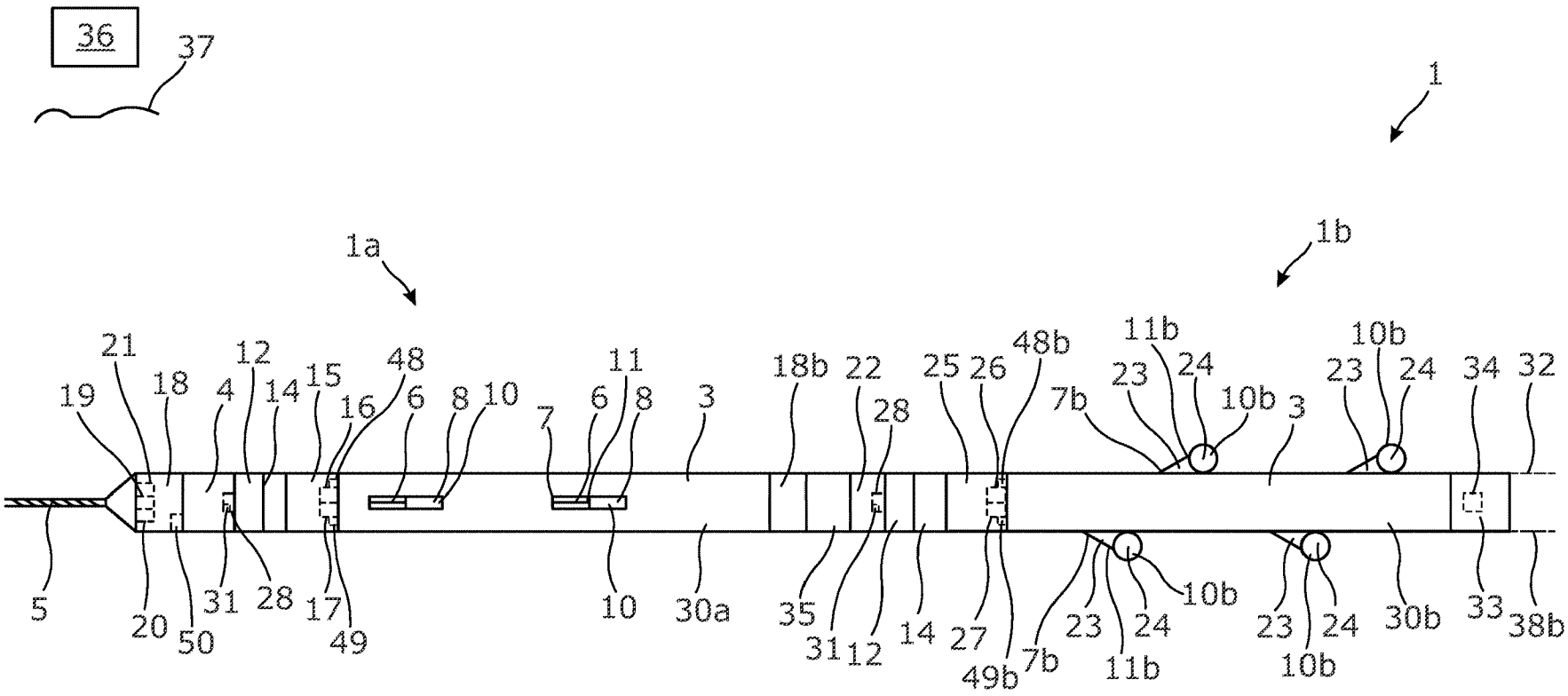
Figure 3:
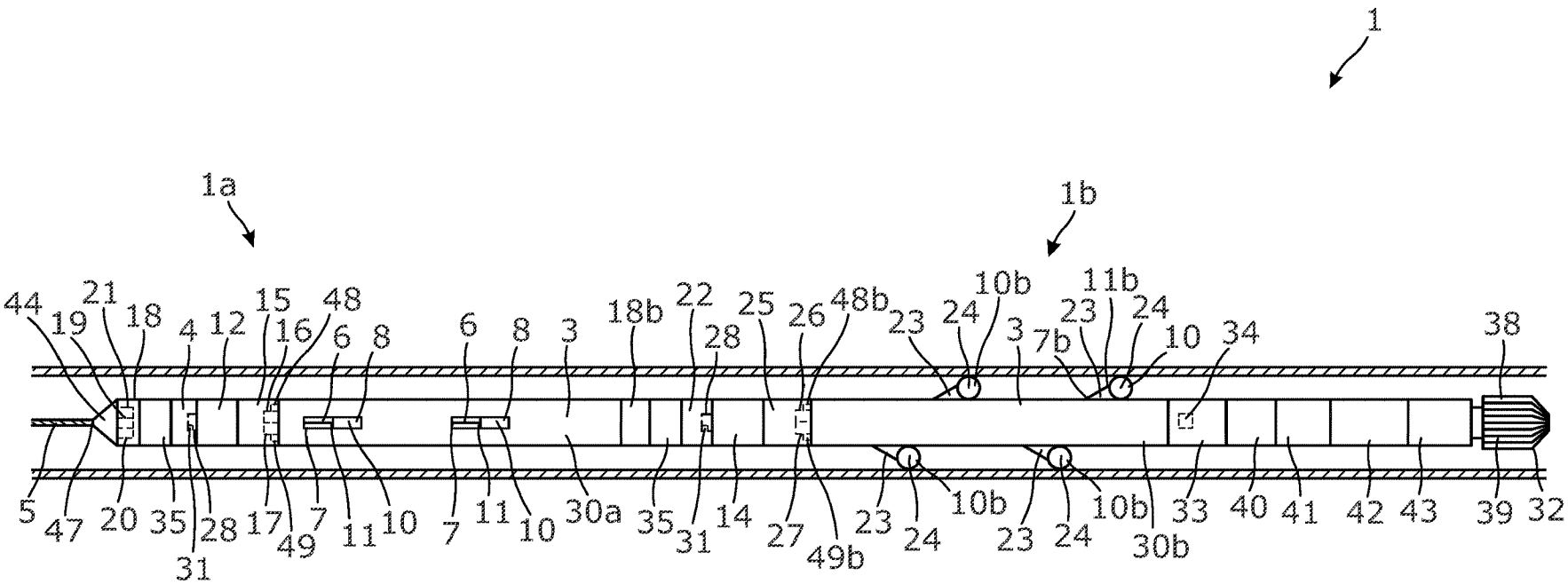
Figure 4:
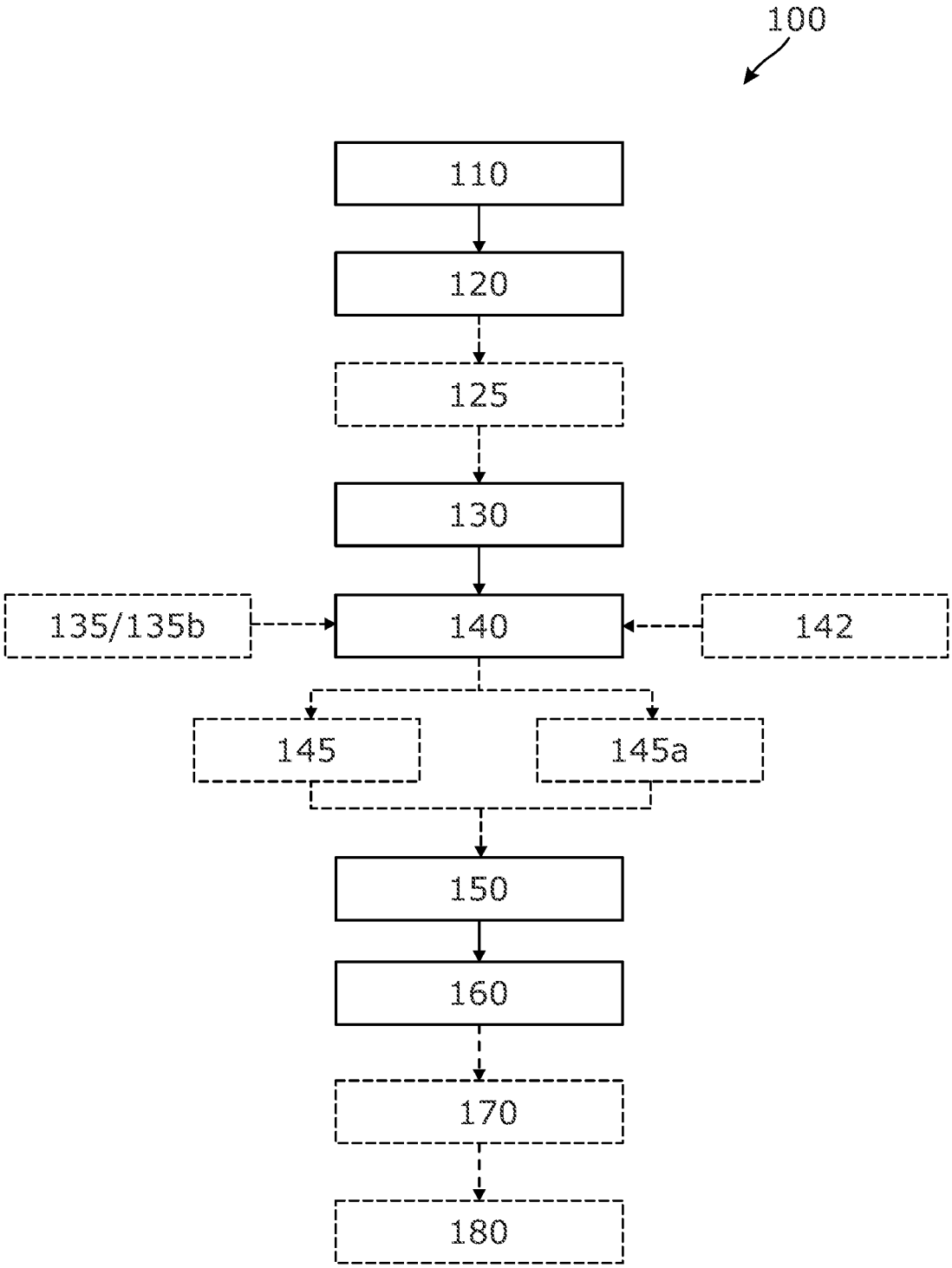
Figure 5:
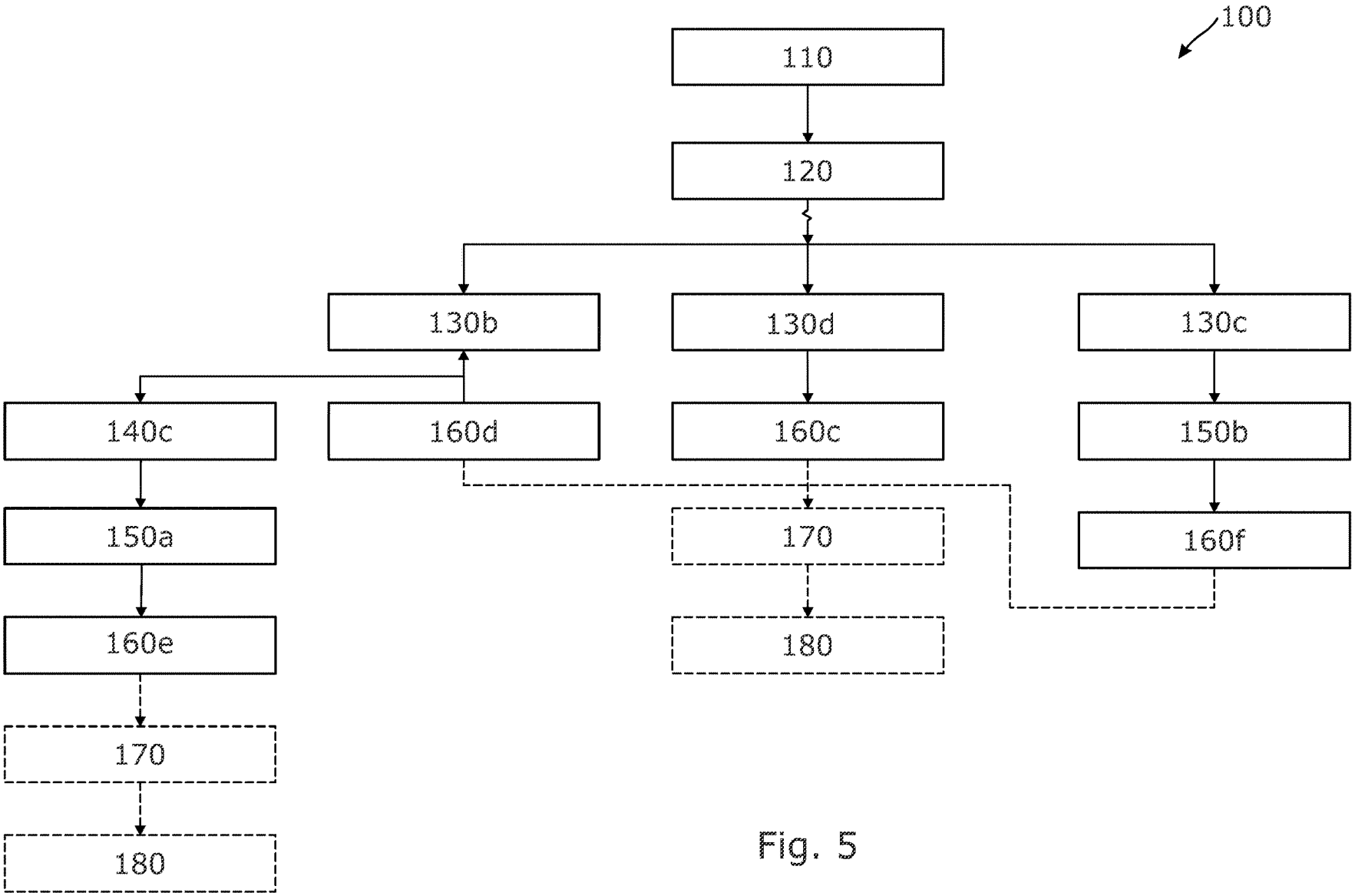
Figure 6:
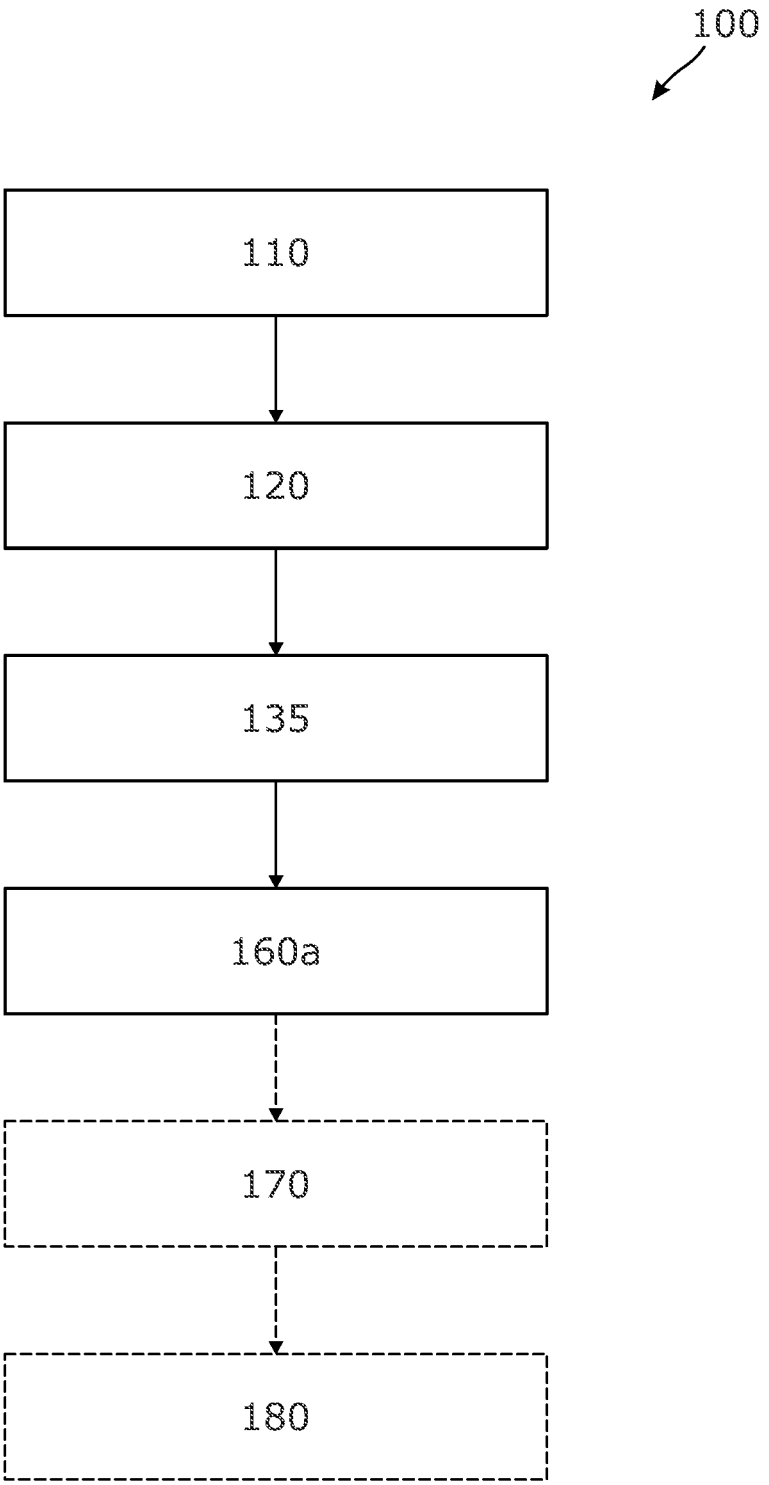

The invention and its many advantages will be described in more detail below with reference to the accompanying schematic drawings, which for the purpose of illustration show some non-limiting embodiments and in which:

FIG. 1 shows two separately working downhole self-propelling wireline tools mounted as one downhole self-propelling wireline tool string according to the invention, FIG. 2 shows another downhole self-propelling wireline tool string, FIG. 3 shows yet another downhole self-propelling wireline tool string having an operational tool with a bit, FIG. 4 shows a downhole self-propelling wireline tool control method for controlling the downhole self-propelling wireline tool string according to the present invention with some optional steps, FIG. 5 shows another downhole self-propelling wireline tool control method with some optional steps for performing an operation downhole, FIG. 6 shows another downhole self-propelling wireline tool control method, and FIG. 7 shows a graph of the power curve in relation to the pulling force and speed of the tool.

All the figures are highly schematic and not necessarily to scale, and they show only those parts which are necessary in order to elucidate the invention, other parts being omitted or merely suggested.

FIG. 1 shows a downhole self-propelling wireline tool string 1 for propelling a tool forward in a well 2 and potentially also for providing weight on a bit 39 (shown in FIG. 3) while performing an operation, as shown in the tool string 1 of FIG. 4. The tool string 1 of FIG. 1 is thus two separately driven downhole self-propelling wireline tools 1*a*, 1*b* mounted as one wireline tool string, where each wireline tool has a separate electric control unit, a separate electric motor, one or two separate hydraulic pumps, a separate hydraulic section 15 and one or more separate drive sections 30, 30*a* 30*b*.

The first downhole self-propelling wireline tool 1*b* comprises a tool body 3, 3*a*, 3*b*, a first electric control unit 18 controlling a first electric motor 4 operating at a rotational speed and powered by a wireline 5. The first downhole self-propelling wireline tool 1*a* further comprises a plurality of projectable arm assemblies 6 movably connected at a first arm end 7 with the tool body 3 and projectable from the tool body 3 by means of a first fluid having a first fluid pressure, and a plurality of wheels 8 for contacting a wall 9 of the well, each wheel 8 comprising a hydraulic motor 10 for rotation of the wheel to provide a self-propelling movement, and each wheel being connected with a second arm end 11 of one of the arm assemblies 6, so that the wheel engages the wall when the arm is projected. The first electric motor 4 is configured to drive a first hydraulic pump 12 for generation of a second fluid pressure for driving the hydraulic motor(s) 10 rotating the wheel(s) 8. The second downhole self-propelling wireline tool 1*b* comprises a second electric control unit 18*b*, a second electric motor 22, a second hydraulic pump 14, a second hydraulic section 25 and a second drive section 30*b* with wheels 24 on arm assemblies 23. The plurality of projectable arm assemblies 23 are movably connected at a first arm end 7*b* with the tool body 3*b*, and each wheel 24 comprises a hydraulic motor 10*b* for rotation of the wheel to provide a self-propelling movement, each wheel 24 being connected with a second arm end 11*b* of one of the arm assemblies 23. The first downhole self-propelling wireline tool 1*a* is connected to a cable head 44 and the wireline 5, and the downhole self-propelling wireline tool string 1 is a hydraulically driven downhole self-propelling wireline tool string. The downhole self-propelling wireline tool 1*a* is connected to a second end 47 of the wireline 5, a first end of the wireline being connected to a power supply (not shown) at the surface or seabed.

Each electric motor 4, 22 of the downhole self-propelling wireline tool string 1 further comprises a power-limiting unit 31, e.g. a current-limiting unit, in order to limit each motor in pulling more power than needed for driving also the second downhole self-propelling wireline tool 1*b* and thus distributing a first part of the current from the wireline to power the first electric motor 4 and a second part of the current to power the second electric motor 22. The first downhole self-propelling wireline tool 1*a* and the second downhole self-propelling wireline tool 1*b* are electrically connected in parallel so that each wireline tool 1*a*, 1*b* can pull what is required to drive at the same speed. By having a power-limiting unit, the power can be distributed optimally as a first part of the current from the wireline to power the first electric motor and a second part of the current to power the second electric motor. This enables driving the downhole self-propelling wireline tool string having at least one pump for each drive section without the first downhole self-propelling wireline tool 1*a* and the second downhole self-propelling wireline tool 1*b* coming out of syncronisation so that one is driving faster than the other and thus functions as a "brake".

By having an electric motor and a pump for each drive section, the downhole self-propelling wireline tool string 1 is able to drive at full speed as one drive section and with double pulling force as two drive sections, as illustrated in FIG. 7. $P_1$ is the power curve, e.g. 3 kW, of a know tool string haivng one pump for driving two drive sections and $P_2$ is the downhole self-propelling wireline tool string of the pressent invention. At low speed, the available pulling force is the same for the known tool string and the tool string of the present invention, but the downhole self-propelling wireline tool string 1 having a pump for each drive section is at high speed able to drive twice as fast as the known tool string having only one pump for driving two drive sections. This is due to the fact that the pumped fluid does not have to travel past one drive section to be delivered to the next, and thus no energy is wasted in the transition from one drive section to the next drive section. By having one pump for one drive section, the diameter of the fluid channels in the drive section can be made larger than when the pump has to provide fluid to more than one drive section. The overall diameter of the tool string 1 is limited by the well, and the pump is therefore often a limiting factor as more pumping capacity would require a larger diameter. By having only one drive section, the pumping force is used directly, and the fluid channel can be made larger, for which reason the limited current in the wireline is used more efficiently than in the known tool strings where several drive sections are driven by one pump.

When intervening a well, the tool string is often restricted also in length by the rig height and/or a lubricator length, which is why there has been a tendency to avoid duplicates and merely add further drive sections to increase the pulling force as this does not lead to an unneccessary increase in the tool length.

Furthermore, the low oil price has also led to a focus on offering tool strings with less expensive parts to provide more cost-effective well intervention without focusing on the amount of time spent on the intervention. However, with an increasing oil price the focus has changed from costs to faster intervention. By having drive sections with an individual motor and pump, the tool string is much more expensive, but the intervention is made much faster without reducing the pulling force.

By each electric motor 4, 22 having a power-limiting unit 31, one drive section does not have to be switched off as both motors drive at the power needed until the motors reach the current limit, each first and second downhole self-propelling wireline tools 1*a*, 1*b* thus being able to propel at a maximum speed until restricted by the power, e.g. the current, available, whereupon the speed and force are continuously adjusted to match the need for pulling the wireline.

The known self-propelling units can be driven at two different speeds, and in order to avoid exceeding the current limit when driving at all drive sections, the tool string propels at the lowest speed. By having an electric motor and a pump for each drive section as in the present invention, each motor is only limited if reaching the current limit, so that each drive section drives at maximum speed and force until restricted. The operation area A, $A_1$ as shown in FIG. 7 is thus larger for downhole self-propelling wireline tool string 1 of the present invention ($A_1$) than the operation area $A_2$ of the known tool string having one pump to drive two drie sections.

The downhole self-propelling wireline tool string 1 may also comprise a current distribution unit 21 in order to distribute a first part of the current from the wireline 5 to power the first electric motor 4 and a second part of the current to power the second electric motor 22. The power to the tool string 1 is thus divided equally between the first and second electric motors 4, 22 so that each motor is limited to half of the current limit, and the tool string does not exceed the allowed current limit on the wireline 5. The current distribution unit 21 may replace the power-limiting unit 31 in each electric motor 4, 22 or may be a supplement to the power-limiting units.

The first downhole self-propelling wireline tool 1*a* further comprises a first pressure sensor 49 continuously measuring the second fluid pressure, and the hydraulic section 15 comprises a first controllable valve 16 controlling the first fluid pressure based on the second pressure. As shown in FIG. 1, the first hydraulic section 15 further comprises a second controllable valve 17 controlling the second fluid pressure. The first hydraulic section 15 is configured to measure the second fluid pressure by means of the first pressure sensor 49 and further comprises a second pressure sensor 48 for measuring the first fluid pressure. The second hydraulic section 25 further comprises a third controllable valve 26 controlling the third fluid pressure and a fourth controllable valve 27 controlling the fourth fluid pressure. The second hydraulic section 25 is configured to measure the third and fourth fluid pressures by means of a third pressure sensor 49*b* and a fourth pressure sensor 48*b*, respectively, and to control the valves based on the measured third and fourth fluid pressures. The controllable valve(s) 16, 17, 26, 27 is/are (a) controllable pressure relief valve(s).

By having a first controllable valve 16 controlling the first fluid pressure based on the second pressure, the wheels 8 are not pressed more outwards than needed. The higher the second pressure, the higher the first pressure needs to be in order to propel the downhole self-propelling wireline tool string 1 forward in the well in the most optimal manner. When having a low second pressure, the first pressure is adjusted to match the low second pressure so that power is not wasted on providing a first fluid pressure higher than needed. Furthermore, if the first fluid pressure is higher than the optimal first fluid pressure matching the present second fluid pressure, then too much friction is applied to the wall of the well, compromising the maximum available velocity of the downhole self-propelling wireline tool string 1.

The first pressure sensor 49 continuously measures the second fluid pressure, and data representing the measured second fluid pressure is communicated to the electric control unit. When the second fluid pressure changes, the electric control unit electrically controls the first controllable valve by conducting electric power to the valve for moving the valve to a more or less open position, and thus the first controllable valve 16 controls the first fluid pressure based on the second fluid pressure. Thus, the sensor and the valve can be seen as a feedback loop where the measurement is fed back to control the valve, and thus an increase or decrease in the second fluid pressure is utilised to provide a resulting action on the valve to increase or decrease the pressure projecting the arms based on the rotational speed of the wheels.

In FIG. 1, the first hydraulic pump 12 generates the first fluid pressure for projection of the plurality of projectable arm assemblies 6, and in FIG. 2 the first and second downhole self-propelling wireline tools 1*a*, 1*b* each comprises the first hydraulic pump 12 for generation of the second fluid pressure for driving the hydraulic motor(s) rotating the wheel(s) and the second hydraulic pump 14 for generation of the first fluid pressure for projection of the plurality of projectable arm assemblies 6.

In FIG. 1, each of the electric control units 18, 18*b* controls the rotational speed of the electric motors 4, 22 and thus also the rotational speed of the pumps as well as the tool speed of the downhole self-propelling wireline tool string 1 along the longitudinal extension of the well as the pumps generate a fluid flow into the wheels 8. At the beginning of the well, closest to the top of the well, the downhole self-propelling wireline tool string 1 requires very little force for pulling the wireline 5 along with the tool string 1, but as the downhole self-propelling wireline tool string 1 proceeds down the well, the tool string 1 requires an increasing amount of force for pulling the wireline 5. As the required force increases, the wheels 8 need higher pressure to rotate, and the pumps thus need more rotational force, i.e. motor output torque, from the first and second motors 4, 22, respectively. Wirelines used for intervention operations where such a downhole self-propelling wireline tool string 1 is used are rated to a maximum current limit depending on the length of the wireline or other wireline parameters. Thus, it is important that such current limit is not exceeded. Knowing of the voltage either by assumption, calculation or measurement, a power limit P of the operation is also known, and this power limit P is shown in FIG. 7. When the motor output torque increases, the current demand increases correspondingly, and when the current limit is reached, the downhole self-propelling wireline tool string 1 needs to reduce its speed, i.e. move along the power limit curve in FIG. 7. This is performed in several ways, where one very simple way is illustrated in FIG. 4.

The adjustment of the operational rotational speed of the electric motor may be performed continuously so as to optimise the pulling force F and speed of the tool string to keep the power demand below the power curve P of the graph in area A shown in FIG. 7 in relation to the pulling force and speed of the tool string. In this way, all available power is used in the most optimal way to ensure that the downhole self-propelling wireline tool string drives at maximum speed while being able to provide the pulling force needed at any location in the well.

In FIG. 4, a method 100 for controlling the downhole self-propelling wireline tool string 1 is illustrated. The method comprises running 110 a downhole self-propelling wireline tool string 1 into the wellbore 2, supplying 120 electric power to the downhole self-propelling wireline tool string to operate the downhole self-propelling wireline tool string at a first speed to urge the downhole self-propelling wireline tool string through the wellbore at a first force, determining 130 a motor output torque of the motors 4, 22, and determining 140 a maximum allowable motor rotational speed based on the motor output torque for the purpose of comparing 150 the operational rotational speed with the maximum allowable motor rotational speed. The control method 100 further comprises adjusting 160 the operational rotational speed of the electric motors 4, 22 based on the comparison in order to adjust the first speed to a second speed if the operational rotational speed is higher than the maximum allowable motor rotational speed. The operational rotational speed of the first and second motors is regulated simultaneously to ensure the same operational rotational speed.

Thereby, a very simple way of adjusting the speed of the hydraulically driven downhole self-propelling wireline tool string 1 is provided as only the motors are adjusted to limit the speed, and the more complex hydraulic sections 15, 25 merely adjust the first controllable valve 16 for controlling the first fluid pressure based on the second pressure and the third controllable valve 26 for controlling the third fluid pressure based on the fourth fluid pressure, thus optimising to ensure that sufficient power is provided to project the wheel arms, but not more than needed. The speed of the hydraulically driven downhole self-propelling wireline tool string 1 is thus adjusted continuously using all available power, i.e. below the current limit, either for driving at a maximum speed or at the required force and the corresponding maximum allowable speed, and the hydraulically driven downhole self-propelling wireline tool string 1 is able to drive at maximum speed until the force to pull the wireline increases to a first force F1 at the power limit curve P in FIG. 7, above which first force F1 the speed and thus the rotational speed of the electric motors 4, 22 need to be reduced so that the current limit is not exceeded. The hydraulically driven downhole self-propelling wireline tool string 1 is thus controlled to continuously adjust its speed to a maximum without exceeding the current limit of the wireline 5. By having first and third controllable valves 16, 26 controlling the first and third fluid pressures based on the second and fourth pressures, the continuous control of the hydraulically driven downhole self-propelling wireline tools 1*a*, 1*b* is optimised even further so that no power is wasted on projecting the arm assemblies 6, 23 out towards the wall of the well other than what is needed for optimal friction between the wheels 8, 24 and the wall to drive the hydraulically driven downhole self-propelling wireline tool string 1 forward.

The step of running 110 comprises running both the first and second downhole self-propelling wireline tools 1*a*, 1*b* into a wellbore 2, and the step of supplying 120 electric power comprises supplying electric power to both the first and second downhole self-propelling wireline tools to operate the first and second downhole self-propelling wireline tools at a first speed to urge the tool string 1 through the wellbore at a first force, and the step of determining 130 comprises determining a motor output torque of both the first and second electric motors 4, 22, and the step of determining 140 comprises determining a maximum allowable motor rotational speed based on the motor output torque of both the first and second electric motors 4, 22, and the step of comparing 150 comprises comparing the operational rotational speed of both the first and second electric motors 4, 22 with the maximum allowable motor rotational speed, and the step of adjusting 160 comprises adjusting the operational rotational speed of both the first and second electric motors 4, 22 based on the comparison in order to adjust the first speed to a second speed if the operational rotational speed is higher than the maximum allowable motor rotational speed. The current available is distributed so that the first electric motor 4 is limited to one half, and the second electric motor 22 is limited to the other half of the maximum current limit. In this way, the motors 4, 22 are operated to run at the same operational rotational speed, consuming a maximum of half the maximum current limit.

The power-limiting units 31 and/or the current distribution unit 21 can distribute the current so that the first downhole self-propelling wireline tool 1*a* and the second downhole self-propelling wireline tool 1*b* equally consume the current from the wireline 5 when the downhole self-propelling wireline tool string 1 is activated. Therefore, the first downhole self-propelling wireline tool 1*a* and the second downhole self-propelling wireline tool 1*b* are configured to consume an equal part of the current from the wireline 5 when the downhole self-propelling wireline tool string 1 is activated.

In FIG. 7, the maximum speed of the hydraulically driven downhole self-propelling wireline tool string 1 is based on the maximum allowed rotational speed of the electric motors 4, 22, and the maximum force is based on the minimum allowed rotational speed of the electric motors 4, 22. When operating the downhole self-propelling wireline tool at low speed, the maximum force available e.g. for pulling the wireline is very high; however, if such high force is not utilised to the full extent the first pressure at which the projectable arms and thus the wheels are pressed against the inner face of the casing/well tubular metal structure may be unnecessarily high causing unnecessary wear of the wheels. Likewise, when operating the downhole self-propelling wireline tool without using a lot of force, e.g. for pulling in the wireline, then the downhole self-propelling wireline tool may drive at a high speed; however, if the downhole self-propelling wireline tool drives at high speed into an obstruction, the downhole self-propelling wireline tool may shut down or be sufficiently damaged. Therefore, the method may comprise the step of reducing the second fluid pressure and/or the first flid pressure to avoid unnecessary wear of the wheels or avoiding shut down.

Each electric control unit 18, 18*b* comprises a motor driver 28, a master and/or a voltage inverter. The power or current-limiting unit 31 may be arranged in the motor drivers 28. As shown in FIG. 4, the electric control units 18, 18*b* determine 145 or the motor drivers 28 determine 145*a* an operational rotational speed of the electric motors 4, 22, and the motor drivers 28 are configured to measure 125 current over the three phases in the motors to determine 130 a motor output torque of the electric motors 4, 22. The electric control units 18, 18*b* or the motor drivers 28 are configured to determine 140 a maximum allowable motor rotational speed based on the motor output torque and to compare 150 the operational rotational speed with the maximum allowable motor rotational speed and then adjust 160 the operational rotational speed of the electric motors 4, 22 based on the comparison in order to adjust the first speed to a second speed if the operational rotational speed is higher than the maximum allowable motor rotational speed. Optionally, determining 140 a maximum allowable motor rotational speed based on the motor output torque may also be based on pre-set values 142 for maximum power or maximum current. Furthermore, the electric control units 18, 18*b* or the motor drivers 28 may measure 135 a current demand of/input to the electric motors 4, 22 and measure 135*b* a voltage input to the electric motors 4, 22, and determining 140 a maximum allowable motor speed based on the motor output torque may thus also be based on a measured current and a measured voltage of the electric motors 4, 22.

By measuring the actual current demand and voltage of each electric motor 4, 22, the maximum allowable motor speed can be determined more precisely as the efficiency of the electric motor varies depending on the operational rotational speed of the electric motor. Thus, at a high rotational speed, the current demand is lower than at a low rotational speed for the same power output, and the maximum power may therefore be varied, being somewhat larger at high rotational speed than when assuming that the maximum power is constant.

The allowable effect of the electric motor 4 varies with temperature so that at lower temperatures, e.g. below 200° C., the electric motor may run at higher effect than at higher temperatures. The downhole self-propelling wireline tool may therefore comprise a temperature sensor for measuring the temperature of the electric motor and adjusting the allowable effect level of the motor accordingly.

The method as shown in FIG. 4 may further comprise controlling 170 the first fluid pressure based on the second fluid pressure by means of the first controllable valve 16 in the first hydraulic section 15 of the first downhole self-propelling wireline tool 1*a* and the third fluid pressure based on the fourth pressure by means of the third controllable valve 26 in the second hydraulic section 25 of the second downhole self-propelling wireline tool 1*b*. The method may optionally further comprise determining 180 the load on the electric motors 4, 22 based on the torque output.

As can been seen in FIG. 1, the first downhole self-propelling wireline tool string 1 has two wheel sections 30*a*, 30*b* where one is rotated 90 degrees around the circumference of the tool in relation to the other in order to centralise the tool in the well along the circumference of the tool string 1. Thus, the first drive section 30*a* is rotated 90 degrees from the second drive section 30*b* so that the projectable arm assemblies 6 of the first drive section 30*a* are rotated 90 degrees from the projectable arm assemblies 23 of the second drive section 30*b*. In another embodiment, both the first downhole self-propelling wireline tool 1*a* and the second downhole self-propelling wireline tool 1*b* comprise the first drive section 30*a* and a second drive section 30*b* which are rotated 90 degrees in relation to each other. The first electric motor 4 and/or the second electric motor 22 is/are (a) synchronous motor(s). Thus, the first downhole self-propelling wireline tool 1*a* comprises two first drive sections 30*a*, and the second downhole self-propelling wireline tool 1*b* comprises two second drive sections 30*b*. Compared to a known self-propelling wireline tool with only one motor and one pump for four drive sections, the downhole self-propelling wireline tool string 1 according to the present invention runs at least twice as fast and preferably almost four times as fast, but has the same pulling force as four drive sections.

The tool string 1 of FIG. 2 is thus two downhole self-propelling wireline tools 1*a*, 1*b* mounted as one wireline tool, where each has a separate electric control unit 18, 18*b*, a separate electric motor 4, 22, two separate hydraulic pumps 12, 14, a separate hydraulic section 15, 25 and one separate drive section 30, 30*a*, 30*b*. The first downhole self-propelling wireline tool 1*a* comprises the electric control unit 18, the electric motor 4, two hydraulic pumps 12, the first hydraulic section 15 and the drive section 30, 30*a* with wheels 8 on arm assemblies 6. The second downhole self-propelling wireline tool 1*b* comprises the electric control unit 18*b*, the electric motor 22, two hydraulic pumps 14, the hydraulic section 25 and the drive section 30, 30*b* with wheels 24 on arm assemblies 23. The first downhole self-propelling wireline tool 1*a* is connected to the cable head 44 and the wireline 5. The hydraulic section 15 is configured to measure the first and second fluid pressures by means of the first pressure sensor 49 and the second pressure sensor 48 and to control the valves based on the measured first and second fluid pressures. The second hydraulic section 25 is configured to measure the third and fourth fluid pressures by means of the third pressure sensor 49*b* and the fourth pressure sensor 48*b* and to control the valves based on the measured third and fourth fluid pressures. The controllable valve(s) 16, 17, 26, 27 is/are (a) controllable pressure relief valve(s). The power to the tool string 1 is thus divided equally between the first and second electric motors 4, 22 so that each motor is limited to half of the current limit to ensure that the tool string 1 does not exceed the allowed current limit on the wireline 5. The current distribution unit 21 is arranged in the first electric control unit 18.

Even though not shown, three or more separately working downhole self-propelling wireline tools may be mounted as one downhole self-propelling wireline tool string. Thereby, a more modular downhole self-propelling wireline tool string is provided.

As shown in FIGS. 1-3, the first drive section 30*a* is connected to the second electric control unit 18*b*, or in another embodiment to the second electric motor 22 of the second downhole self-propelling wireline tool 1*b*. Thus, the first downhole self-propelling wireline tool 1*a* is connected in one end with the wireline 5 and in another end with the second downhole self-propelling wireline tool 1*b*.

By having one pump for each drive section 30*a*, 30*b*, the diameter of the fluid channels in the drive sections can be made much larger than in the known tools where one pump has to provide fluid to all drive sections. By having only one drive section for each pump, the fluid channels can be made larger, and the limited current in the wireline is thus used more efficiently than in known tool strings where all drive sections are driven by one pump. In the present invention, a fluid channel for the first fluid or the third fluid for projecting the arm assemblies 6, 23 from the tool body 3 has a first inner channel diameter, and the drive section has an outer drive section diameter, where the ratio between the first inner channel diameter and the outer drive section diameter is higher than 0.3/10, preferably higher than 0.4/10, and more preferably higher than 0.5/10. A second channel for the second fluid or the fourth fluid for driving the hydraulic motor(s) 10, 10*b* rotating the wheel(s) 8, 24 has a second inner channel diameter, and the ratio between the second inner channel diameter and the outer drive section diameter is higher than 0.5/10, preferably higher than 0.8/10, and more preferably higher than 1.0/10.

The downhole self-propelling wireline tool string 1 further comprises a compensator 35 for providing a predetermined overpressure in the tool so that the well fluid does not enter into the tool and jeopardise the function of the tool, and so that the dirty well fluid is not mixed with the hydraulic fluid in the tool.

As shown in FIG. 1, the downhole self-propelling wireline tool string 1 further comprises a surface readout module 29 communicating instructions from surface to each tool and sending measured tool parameters, such as the first fluid pressure, the second fluid pressure, the third fluid pressure, the fourth fluid pressure, the operational rotational speed of the electric motors 4, 22 and/or the motor output torque, to surface.

In FIG. 3, the downhole self-propelling wireline tool string 1 comprises an operational tool 38, such as a logging tool 38*b* (shown in FIG. 2) or a machining tool 32 having the bit 39 for performing a machining operation and a compression sub 33 comprising a load cell 34 adjacent to the machining tool 32 in order to measure the actual weight on the bit 39. The operational tool 38 further comprises an electric control unit 40, a compensator 41, an electric motor 42 and a gear section 43 for rotating the bit 39 at another speed than the rotational speed of the motor 42, often at a lower speed. The compression sub 33 comprising the load cell 34 is arranged between the electric control unit 40 and the drive section 30*b* comprising the wheels 24 on the projectable arm assemblies 23.

The electric control unit(s) 18, 18*b* further comprise(s) a voltage control unit 19 having an overvoltage protection unit, so that voltage fed to the tool is kept more constant, and an electric current measuring unit 20. In FIG. 2, the electric control unit 18 comprises a capacitor 50 functioning as an energy storage unit or accumulator. The downhole self-propelling wireline tool string 1 further comprises the machining tool 32 for performing a machining operation and the compression sub 33 comprising the load cell 34 adjacent to the machining tool 32. In another embodiment, the electric control unit(s) 18, 18*b* control(s) the controllable valve(s) 16, 17, 26, 27 based on the electric current and/or electric voltage measured by the electric control unit.

In FIG. 2, the downhole self-propelling wireline tool string 1 comprises a user interface 36 at a surface 37 for controlling at least part of the downhole self-propelling wireline tool string 1. Thus, the field engineer may be informed of the current limit of the wireline/cable and through the user interface 36 set the current limit for each motor of the tool, and the power-limiting units 31 or the current distribution unit 21 distributes the current equally between the first downhole self-propelling wireline tool 1*a* and the second downhole self-propelling wireline tool 1*b* so that both are able to drive at the same speed and therefore drive the tool string 1 at the same speed. The first electric motor 4 may require more power than the second electric motor 22 in order to drive the tool string 1 at the same speed, but this is possible as the first and second downhole self-propelling wireline tools 1*a*, 1*b* are electrically connected in parallel. The downhole self-propelling wireline tool string 1 may further comprise a stroking tool, even though not shown.

In FIG. 5, the method comprises continuously measuring 130*d* the first/third fluid pressure by means of the first/third pressure sensor 49, 49*b* and the adjusting 160*c* of the rotational speed of the electric motor 4, 22 is based on the first fluid pressure as a supplement to or instead of steps 130-150.

The method as shown in FIGS. 4, 5 and 6 further comprises controlling 170 the first fluid pressure based on the second/fourth pressure by means of the first/third controllable valve 16, 26 in the hydraulic section 15, 25 of the downhole self-propelling wireline tool 1*a*, 1*b*. The method may optionally further comprise determining 180 the load on the electric motor 4, 22 based on the torque output.

In FIG. 5, the method comprises continuously measuring 130*b* the second/fourth fluid pressure of the second/fourth fluid, and the adjusting 160*d* of the operational rotational speed of the electric motors 4, 22 is based on the second/fourth fluid pressure as a supplement to or instead of steps 130-150.

When the downhole self-propelling wireline tool string 1 further comprises the operational tool 32 having the bit 39 for performing an operation downhole, such as milling, and the downhole self-propelling wireline tool string 1 has propelled itself to the point where the milling operation is to be performed, the method further comprises measuring 130*b* the second/fourth fluid pressure, estimating 140*c* a weight on bit (WOB), comparing 150*a* the estimated weight on bit with a predetermined weight on bit, and adjusting 160*e* the second/fourth fluid pressure based on the comparison, as shown in FIG. 5. The steps 130*b*, 140*c*, 150*a* and 160*e* may be a supplement to or instead of steps 130-160.

When the downhole self-propelling wireline tool string 1 also comprises the compression sub 33 and the operational tool 32 having the bit 39 for performing an operation downhole, such as milling, the method may further comprise measuring 130*c* a weight on bit by means of the compression sub 33, comparing 150*b* the measured weight on bit with a predetermined weight on bit, and adjusting 160*f* the second/fourth fluid pressure based on the comparison, as shown in FIG. 5. The steps 130*c*, 150*b* and 160*f* may be a supplement to or instead of steps 130-160.

As shown in FIG. 6, the adjusting 160*a* of the operational rotational speed of the electric motor 4 may also be based on a measured current demand of the electric motor or a calculated load on the electric motor.

The downhole self-propelling wireline tool string 1 may further comprise a stroking tool, even though not shown. A stroking tool is a tool providing an axial force. The stroking tool comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

Although the invention has been described above in connection with preferred embodiments of the invention, it will be evident to a person skilled in the art that several modifications are conceivable without departing from the invention as defined by the following claims.

The invention claimed is:

1. A downhole self-propelling wireline tool string for being connected to and powered by a wireline for propelling a tool forward in a well and/or for providing weight on a bit while performing an operation, comprising a first downhole self-propelling wireline tool, comprising:

a first tool body, a first electric motor operating at a rotational speed, a first electric control unit for controlling the rotational speed of the electric motor, one first drive section, comprising a plurality of projectable arm assemblies movably connected at a first arm end with the tool body and projectable from the tool body by means of a first fluid having a first fluid pressure, and a plurality of wheels for contacting a wall of the well, each wheel comprising a hydraulic motor for rotation of the wheel to provide a self-propelling movement, and each wheel being connected with a second arm end of one of the arm assemblies, a first hydraulic pump driven by the electric motor for generation of a second fluid pressure of a second fluid for driving the hydraulic motor(s) rotating the wheel(s), and wherein the downhole self-propelling wireline tool string further comprises a second downhole self-propelling wireline tool, comprising:

a second tool body, a second electric motor operating at a rotational speed, a second electric control unit for controlling the rotational speed of the electric motor, one second drive section comprising:

a plurality of projectable arm assemblies movably connected at a first arm end with the tool body and projectable from the tool body by means of a third fluid having a third fluid pressure, and a plurality of wheels for contacting the wall of the well, each wheel comprising a hydraulic motor for rotation of the wheel, and each wheel being connected with a second arm end of one of the arm assemblies, at least one second hydraulic pump driven by the second electric motor for generation of a fourth fluid pressure of a fourth fluid for driving the hydraulic motor(s) rotating the wheel(s), and wherein each electric motor comprises a power-limiting unit configured to distribute a first part of the current from the wireline to power the first electric motor and a second part of the current to power the second electric motor.

2. A downhole self-propelling wireline tool string according to claim 1, wherein the power-limiting unit is a current-limiting unit limiting the current supplied to the electric motor.

3. A downhole self-propelling wireline tool string according to claim 1, wherein the downhole self-propelling wireline tool string comprises a current distribution unit in order to distribute a first part of the current from the wireline to power the first electric motor and a second part of the current to power the second electric motor.

4. A downhole self-propelling wireline tool string according to claim 3, wherein the current distribution unit is arranged in the first electric control unit.

5. A downhole self-propelling wireline tool string according to claim 1, wherein the first drive section is rotated 90 degrees from the second drive section so that the projectable arm assemblies of the first drive section are rotated 90 degrees from the projectable arm assemblies of the second drive section.

6. A downhole self-propelling wireline tool string according to claim 1, wherein the first electric control unit is connected to the first electric motor, which is connected to the first hydraulic pump, which is connected with the first drive section.

7. A downhole self-propelling wireline tool string according to claim 1, wherein the first drive section is connected to the second electric control unit or the second electric motor of the second downhole self-propelling wireline tool.

8. A downhole self-propelling wireline tool string according to claim 1, wherein the first downhole self-propelling wireline tool further comprises a first pressure sensor measuring the second fluid pressure, and a first hydraulic section comprises a first controllable valve controlling the first fluid pressure based on the second fluid pressure.

9. A downhole self-propelling wireline tool string according to claim 8, wherein the first controllable valve is electronically controllable by means of the first electric control unit.

10. A downhole self-propelling wireline tool string according to claim 1, wherein the second downhole self-propelling wireline tool further comprises a third pressure sensor measuring the fourth fluid pressure and a second hydraulic section comprising a third controllable valve controlling the third fluid pressure based on the fourth fluid pressure.

11. A downhole self-propelling wireline tool string according to claim 10, wherein the first hydraulic section further comprises a second controllable valve controlling the second fluid pressure, the second controllable valve being electronically controllable by means of the second electric control unit.

12. A downhole self-propelling wireline tool string according to claim 1, wherein the first downhole self-propelling wireline tool is connected in one end with the wireline and in another end with the second downhole self-propelling wireline tool.

13. A downhole self-propelling wireline tool string according to claim 1, wherein the first downhole self-propelling wireline tool comprises a second first hydraulic pump generating the first fluid pressure for projection of the plurality of projectable arm assemblies of the first drive section, and the second downhole self-propelling wireline tool comprises a second hydraulic pump generating the third fluid pressure for projection of the plurality of projectable arm assemblies of the second drive section.

14. A downhole self-propelling wireline tool string according to claim 1, wherein the first hydraulic pump generates the first fluid pressure for projection of the plurality of projectable arm assemblies of the first drive section, and the second hydraulic pump generates the third fluid pressure for projection of the plurality of projectable arm assemblies of the second drive section.

15. A downhole self-propelling wireline tool string according to claim 1, wherein a fluid channel for the first fluid or the third fluid for projecting the arm assemblies from the tool body has a first inner channel diameter, and the drive section has an outer drive section diameter, where the ratio between the first inner channel diameter and the outer drive section diameter is higher than 0.3/10.

16. A downhole self-propelling wireline tool string according to claim 15, wherein the ratio is higher than 0.4/10.

17. A downhole self-propelling wireline tool string according to claim 15, wherein the ratio is higher than 0.5/10.

18. A downhole self-propelling wireline tool string according to claim 1, wherein a second channel for the second fluid or the fourth fluid for driving the hydraulic motor(s) rotating the wheel(s) has a second inner channel diameter, and the drive section has an outer drive section diameter, where the ratio between the second inner channel diameter and the outer drive section diameter is higher than 0.5/10.

19. A downhole self-propelling wireline tool string according to claim 1, wherein the power limiting unit is configured to 1) in a first mode, drive the first and second drive sections at the same time at a first speed, and 2) in a second mode, drive only one of the first and second drive sections at a second speed that is greater than the first speed.

20. A downhole self-propelling wireline tool string according to claim 1, wherein the power limiting unit is configured to 1) in a first mode, drive the first and/or second drive sections at the same time at a first speed, and 2) in a second mode, drive the first and second drive sections at the same time at a second speed, the first speed is about twice as fast as the second speed, the pulling force in the second mode is greater than a pulling force in the first mode, and the power consumption in the first and second modes is approximately equal.

* * * * *